US009091204B2

(12) United States Patent
McAlister

(10) Patent No.: US 9,091,204 B2
(45) Date of Patent: Jul. 28, 2015

(54) INTERNAL COMBUSTION ENGINE HAVING PISTON WITH PISTON VALVE AND ASSOCIATED METHOD

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 14/213,767

(22) Filed: Mar. 14, 2014

(65) Prior Publication Data

US 2014/0261347 A1 Sep. 18, 2014

Related U.S. Application Data

(60) Provisional application No. 61/801,342, filed on Mar. 15, 2013.

(51) Int. Cl.
*F01L 11/02* (2006.01)
*F02B 75/02* (2006.01)
(Continued)

(52) U.S. Cl.
CPC . *F02B 75/02* (2013.01); *F01L 1/08* (2013.01); *F01L 11/02* (2013.01); *F01L 21/04* (2013.01); *F02F 3/24* (2013.01); *F02B 2075/025* (2013.01)

(58) Field of Classification Search
CPC ..... F02F 3/34; F02F 3/28; F15B 11/00; F15B 11/042; F01L 11/02; F01L 11/04; F01L 3/20; F02B 33/44; F02D 23/00; F01P 7/14; F02M 37/04
USPC ..... 123/65 R, 73 A, 73 AA, 73 AV, 73 AB, 123/197.2, 47 A
See application file for complete search history.

(56) References Cited

U.S. PATENT DOCUMENTS 1,037,437 A 9/1912 Chase
1,310,565 A 7/1919 Grunwald
(Continued)

FOREIGN PATENT DOCUMENTS

DE 2410473 A1 9/1975
DE 3151368 A1 8/1982
(Continued)

OTHER PUBLICATIONS

"Clean, Efficient and Lightweight Propulsion Systems for a Better World," EcoMotors International, Accessed May 19, 2011, http://www.ecomotors.com. 2 pages.
(Continued)

*Primary Examiner* — Lindsay Low
*Assistant Examiner* — Grant Moubry
(74) *Attorney, Agent, or Firm* — Perkins Coie LLP

(57) ABSTRACT

An internal combustion engine comprising a combustion chamber having a surrounding sidewall with a piston slideably disposed in the surrounding sidewall. A motion conversion mechanism is connected to the piston via a piston rod, and is operative to convert reciprocating motion of the piston into rotary motion. The motion conversion mechanism comprises a cam drum and at least one roller connected to the piston rod. A piston valve including a valve head and a valve stem extends through the piston. The piston valve is moveable between an open position and a closed position to control fluid movement through the flow passage. The valve head is pivotably connected to the valve stem and the engine includes a linkage connected to the valve head that is operative to pivot the valve head between an intake position and an exhaust position.

20 Claims, 8 Drawing Sheets

(51) Int. Cl.

| | |
|---|---|
| ***F02F 3/24*** | (2006.01) |
| ***F01L 1/08*** | (2006.01) |
| ***F01L 21/04*** | (2006.01) |

(56) References Cited

U.S. PATENT DOCUMENTS

| | | | | |
|---|---|---|---|---|
| 1,401,612 | A | | 12/1921 | Landgrebe |
| 1,451,384 | A | | 4/1923 | Whyte |
| 1,693,931 | A | | 12/1928 | Lowe |
| 1,765,237 | A | | 6/1930 | King |
| 1,773,995 | A | | 8/1930 | Goldsborough |
| 2,255,203 | A | | 9/1941 | Wiegand |
| 2,391,220 | A | | 12/1945 | Beeh |
| 2,459,286 | A | | 1/1949 | Wiegand et al. |
| 2,710,600 | A | | 6/1955 | Nallinger |
| 2,826,395 | A | | 3/1958 | Petty |
| 3,060,912 | A | | 10/1962 | May |
| 3,094,974 | A | | 6/1963 | Barber |
| 3,123,061 | A | | 3/1964 | Budroni |
| 3,173,409 | A | | 3/1965 | Warren |
| 3,266,234 | A | | 8/1966 | Cook |
| 3,315,650 | A | | 4/1967 | Bishop et al. |
| 3,373,724 | A | | 3/1968 | Papst |
| 3,682,142 | A | | 8/1972 | Newkirk |
| 3,754,841 | A | | 8/1973 | Grabb et al. |
| 3,792,762 | A | | 2/1974 | Ball et al. |
| 3,815,555 | A | | 6/1974 | Tubeuf |
| 3,829,368 | A | | 8/1974 | Wesley |
| 3,830,204 | A | | 8/1974 | McAlister |
| 3,908,625 | A | | 9/1975 | Romy |
| 3,926,169 | A | | 12/1975 | Leshner et al. |
| 3,976,034 | A | | 8/1976 | Shinohara et al. |
| 3,980,061 | A | | 9/1976 | McAlister |
| 4,003,343 | A | | 1/1977 | Lee |
| 4,020,803 | A | | 5/1977 | Thuren et al. |
| 4,041,910 | A | | 8/1977 | Houseman |
| 4,046,522 | A | | 9/1977 | Chen et al. |
| 4,066,046 | A | | 1/1978 | McAlister |
| 4,086,877 | A | | 5/1978 | Henkel et al. |
| 4,086,878 | A | | 5/1978 | Eisele et al. |
| 4,099,489 | A | | 7/1978 | Bradley |
| 4,108,114 | A | | 8/1978 | Kosaka et al. |
| 4,109,461 | A | | 8/1978 | Fujitani et al. |
| 4,111,160 | A | | 9/1978 | Talenti |
| 4,140,090 | A | | 2/1979 | Lindberg |
| 4,161,657 | A | | 7/1979 | Shaffer, Jr. |
| 4,165,616 | A | | 8/1979 | Pierpoline |
| 4,181,100 | A | | 1/1980 | Yamane et al. |
| 4,201,160 | A | | 5/1980 | Fenne |
| 4,211,200 | A | | 7/1980 | Rocchio et al. |
| 4,235,533 | A | | 11/1980 | Norris |
| 4,244,330 | A | | 1/1981 | Baugh et al. |
| 4,249,386 | A | | 2/1981 | Smith et al. |
| 4,253,428 | A | | 3/1981 | Billings et al. |
| 4,340,013 | A | | 7/1982 | Lindstrom |
| 4,362,137 | A | | 12/1982 | O'Hare |
| 4,373,671 | A | | 2/1983 | Giardini |
| 4,376,097 | A | | 3/1983 | Emelock |
| 4,381,740 | A | | 5/1983 | Crocker |
| 4,382,189 | A | | 5/1983 | Wilson |
| 4,408,595 | A | | 10/1983 | Broyles et al. |
| 4,418,653 | A | | 12/1983 | Yoon |
| 4,441,469 | A | | 4/1984 | Wilke |
| 4,442,801 | A | | 4/1984 | Glynn et al. |
| 4,475,484 | A | | 10/1984 | Filho et al. |
| 4,503,813 | A | | 3/1985 | Lindberg |
| 4,515,135 | A | | 5/1985 | Glass |
| 4,547,356 | A | | 10/1985 | Papineau |
| 4,603,671 | A | | 8/1986 | Yoshinaga et al. |
| 4,606,308 | A | | 8/1986 | Furlong |
| 4,642,992 | A | | 2/1987 | Julovich |
| 4,656,993 | A | | 4/1987 | Yuzawa et al. |
| 4,663,938 | A | | 5/1987 | Colgate |
| 4,716,859 | A | | 1/1988 | Konig et al. |
| 4,722,303 | A | | 2/1988 | Leonhard |
| 4,744,343 | A | | 5/1988 | Bisenius et al. |
| 4,765,304 | A | | 8/1988 | Brown |
| 4,768,341 | A | | 9/1988 | Nozaki et al. |
| 4,771,754 | A | | 9/1988 | Reinke |
| 4,783,966 | A | | 11/1988 | Aldrich |
| 4,834,033 | A | * | 5/1989 | Larsen ..... 123/56.8 |
| 4,839,247 | A | | 6/1989 | Levy et al. |
| 4,846,114 | A | | 7/1989 | List |
| 4,865,002 | A | | 9/1989 | Borst et al. |
| 4,890,528 | A | | 1/1990 | Kamijima |
| 4,892,065 | A | | 1/1990 | List |
| 4,918,916 | A | | 4/1990 | Tiberg |
| 4,936,279 | A | | 6/1990 | Ragg |
| 4,944,277 | A | | 7/1990 | Olson |
| 4,967,708 | A | | 11/1990 | Linder et al. |
| 4,971,009 | A | | 11/1990 | Washino et al. |
| 4,974,571 | A | | 12/1990 | Oppenheim et al. |
| 4,982,708 | A | | 1/1991 | Stutzenberger |
| 5,010,734 | A | | 4/1991 | Ho |
| 5,025,769 | A | | 6/1991 | Plohberger et al. |
| 5,067,467 | A | | 11/1991 | Hill et al. |
| 5,108,266 | A | | 4/1992 | Hewitt |
| 5,115,771 | A | | 5/1992 | Ozawa |
| 5,119,779 | A | | 6/1992 | Plohberger et al. |
| 5,149,600 | A | | 9/1992 | Yamase et al. |
| 5,150,668 | A | | 9/1992 | Bock |
| 5,153,834 | A | | 10/1992 | Abo et al. |
| 5,183,011 | A | | 2/1993 | Fujii et al. |
| 5,201,286 | A | * | 4/1993 | Kerrigan ..... 123/47 A |
| 5,207,185 | A | | 5/1993 | Greiner et al. |
| 5,218,941 | A | | 6/1993 | Suzuki et al. |
| 5,222,481 | A | | 6/1993 | Morikawa |
| 5,228,293 | A | | 7/1993 | Vitale |
| 5,229,977 | A | | 7/1993 | Owen |
| 5,261,238 | A | | 11/1993 | Olsen |
| 5,279,260 | A | | 1/1994 | Munday |
| 5,305,714 | A | | 4/1994 | Sekiguchi et al. |
| 5,315,973 | A | | 5/1994 | Hill et al. |
| 5,321,980 | A | | 6/1994 | Hering et al. |
| 5,343,699 | A | | 9/1994 | McAlister |
| 5,357,908 | A | | 10/1994 | Sung et al. |
| 5,390,647 | A | | 2/1995 | Schechter |
| 5,394,852 | A | | 3/1995 | McAlister |
| 5,399,251 | A | | 3/1995 | Nakamats |
| 5,447,142 | A | | 9/1995 | Bailey |
| 5,488,932 | A | | 2/1996 | Serafini |
| 5,497,744 | A | | 3/1996 | Nagaosa et al. |
| 5,505,824 | A | | 4/1996 | McElroy |
| 5,512,145 | A | | 4/1996 | Hollenberg |
| 5,522,358 | A | | 6/1996 | Clarke |
| 5,531,199 | A | | 7/1996 | Bryant et al. |
| 5,566,450 | A | | 10/1996 | Rao et al. |
| 5,590,635 | A | | 1/1997 | Piock et al. |
| 5,613,475 | A | | 3/1997 | Firey |
| 5,632,870 | A | | 5/1997 | Kucherov |
| 5,647,336 | A | | 7/1997 | Piock et al. |
| 5,666,928 | A | | 9/1997 | Ma |
| 5,676,096 | A | | 10/1997 | Nishi et al. |
| 5,685,272 | A | | 11/1997 | Paul et al. |
| 5,692,458 | A | | 12/1997 | Green |
| 5,715,788 | A | | 2/1998 | Tarr et al. |
| 5,743,241 | A | | 4/1998 | Wood et al. |
| 5,806,474 | A | | 9/1998 | Paul et al. |
| 5,824,890 | A | | 10/1998 | La Palm et al. |
| 5,837,110 | A | | 11/1998 | Dean |
| 5,899,071 | A | | 5/1999 | Stone et al. |
| 5,900,330 | A | | 5/1999 | Kagatani |
| 5,910,773 | A | | 6/1999 | Brownlee |
| 5,983,855 | A | | 11/1999 | Benedikt et al. |
| 5,991,670 | A | | 11/1999 | Mufford et al. |
| 6,155,212 | A | | 12/2000 | McAlister |
| 6,172,500 | B1 | | 1/2001 | Bicking |
| 6,239,336 | B1 | | 5/2001 | Orii et al. |
| 6,260,546 | B1 | | 7/2001 | Vaughn |
| 6,289,869 | B1 | | 9/2001 | Elliott |
| 6,298,825 | B1 | | 10/2001 | Hupperich et al. |
| 6,341,591 | B1 | | 1/2002 | Tsutsumi et al. |
| 6,374,799 | B1 | | 4/2002 | Firey |
| 6,446,597 | B1 | | 9/2002 | McAlister |

(56) References Cited

U.S. PATENT DOCUMENTS

| | | | | |
|---|---|---|---|---|
| 6,463,889 | B2 | 10/2002 | Reddy | |
| 6,640,778 | B1 | 11/2003 | Hori | |
| 6,679,233 | B1 | 1/2004 | Melbourne | |
| 6,729,290 | B1 * | 5/2004 | Rorke | 123/193.6 |
| 6,756,140 | B1 | 6/2004 | McAlister | |
| 6,787,258 | B2 | 9/2004 | Prerad | |
| 6,799,541 | B1 | 10/2004 | Clinton et al. | |
| 6,945,208 | B2 | 9/2005 | Yonezawa et al. | |
| 7,159,544 | B1 | 1/2007 | Studdert et al. | |
| 7,191,738 | B2 | 3/2007 | Shkolnik | |
| 7,194,989 | B2 * | 3/2007 | Hallenbeck | 123/56.1 |
| 7,267,106 | B2 | 9/2007 | Adachi et al. | |
| 7,290,506 | B2 | 11/2007 | Rau, III et al. | |
| 7,451,728 | B1 | 11/2008 | Geer | |
| 7,628,137 | B1 | 12/2009 | McAlister | |
| 7,785,451 | B2 | 8/2010 | Lin et al. | |
| 7,927,434 | B2 | 4/2011 | Nakamura et al. | |
| 7,958,864 | B2 | 6/2011 | Sturman | |
| 8,026,288 | B2 | 9/2011 | Takenouchi et al. | |
| 8,051,944 | B2 | 11/2011 | Nakatsu | |
| 8,245,694 | B2 | 8/2012 | Kuhnke et al. | |
| 8,311,723 | B2 | 11/2012 | McAlister | |
| 8,342,153 | B2 | 1/2013 | Sturman | |
| 8,555,828 | B2 * | 10/2013 | Jones | 123/47 A |
| 2003/0012985 | A1 | 1/2003 | McAlister | |
| 2003/0209013 | A1 * | 11/2003 | Tsai | 60/370 |
| 2004/0045823 | A1 | 3/2004 | Kawase et al. | |
| 2004/0163954 | A1 | 8/2004 | Gurry et al. | |
| 2006/0042597 | A1 | 3/2006 | Magel | |
| 2006/0054138 | A1 | 3/2006 | Geyer | |
| 2006/0060468 | A1 | 3/2006 | Weinand | |
| 2006/0213760 | A1 | 9/2006 | Tao et al. | |
| 2007/0062813 | A1 | 3/2007 | Gentalen et al. | |
| 2007/0221500 | A1 | 9/2007 | Hausselt et al. | |
| 2008/0047831 | A1 | 2/2008 | Richert et al. | |
| 2008/0271709 | A1 | 11/2008 | Dingle | |
| 2009/0065438 | A1 | 3/2009 | Chau | |
| 2009/0151686 | A1 * | 6/2009 | Nguyen | 123/193.2 |
| 2009/0199828 | A1 | 8/2009 | Luttgeharm | |
| 2010/0122688 | A1 | 5/2010 | Sihler et al. | |
| 2010/0263619 | A1 | 10/2010 | Reymond et al. | |
| 2012/0234297 | A1 * | 9/2012 | McAlister et al. | 123/47 R |

FOREIGN PATENT DOCUMENTS

| | | | |
|---|---|---|---|
| DE | 3421779 | A1 * | 2/1985 |
| DE | 3443022 | A1 | 5/1986 |
| EP | 1245800 | A1 * | 10/2002 |
| FR | 2262195 | A1 | 9/1975 |
| GB | 1002694 | A | 8/1965 |
| GB | 1038490 | A | 8/1966 |
| GB | 1336636 | A | 11/1973 |
| GB | 2112455 | A | 7/1983 |
| WO | WO-95/27845 | A1 | 10/1995 |
| WO | WO 2006060859 | A1 * | 6/2006 |

OTHER PUBLICATIONS

Collier Technologies Technology Description; "HCNG"; Nov. 2005; 4 pages.

Davis et al., "Fuel Injection and Positive Ignition-A Basis for Improved Efficiency and Economy", SAE Progress in Technology Review vol. II, Society of Automotive Engineers, 1967, pp. 343-357.

Finegold, et al., "Dissociated Methanol as a Consumable Hydride for Automobiles and Gas Turbines", Jun. 1982, pp. 1359-1369.

Finsterwalder, "Deutz Converts Operation by Adding High-Tension Ignition System", Automotive Engineering, Dec. 1971, pp. 28-32.

James W. Heffel, University of California; "Hydrogen Powered Shelby Cobra: Vehicle Conversion"; 2003; 14 pages.

Jim Stanam; "How Can Engines Be Modified to Run Using Alternative Fuels?"; Lockheed Martin; Orlando, FL; Jan. 2, 1999, 4 pages.

Robert Priest, Appeal T 383/04-3.2.4 in respect of European Patent Application No. 94920655.1-2311 of Roy E. McAlister; "Declaration of Robert Priest"; Nov. 30, 2005; 3 pages.

Schwartz, Ariel, "Bill Gates, Khosla Ventures lnejct $23.5 Million Into Engine Startup EcoMotors," FastCompany, Jul. 12, 2010, Accessed May 31, 2011, http://www.fastcompany.com/1669471/bill-gates-khosla-ventures-inject-235-million-into-efficient-engine-startup-ecomotors. 2 pages.

Simko et al., "Exhaust Emission Control by the Ford Programmed Combustion Process-PROCO", SAE Paper No. 720052, pp. 249-264.

Charles W. Lopez, Kenneth W. Stone; Contractor Report; Performance of the Southern California Edison Company Stirling Dish; Oct. 1993.

* cited by examiner

INTERNAL COMBUSTION ENGINE HAVING PISTON WITH PISTON VALVE AND ASSOCIATED METHOD

CROSS-REFERENCE TO RELATED APPLICATIONS

The present application claims the benefit of U.S. Provisional Patent Application No. 61/801,342, filed Mar. 15, 2013, the disclosure of which is incorporated herein by reference in its entirety.

BACKGROUND

Traditional internal combustion engine operation relies on an expensive valve train including valves, springs, camshafts, and associated bearings and oiling system components, all of which have a negative effect on the primary and maintenance costs and operating efficiency of an engine. Accordingly, there is a need for engine designs that reduce the losses associated with traditional valve train designs in order to increase engine efficiency.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various views unless otherwise specified.

DETAILED DESCRIPTION

Disclosed herein are novel internal combustion engine designs. The traditional valve train is eliminated in favor of a rocking or tilting monovalve, or piston valve, for controlling intake and exhaust flow into and out of the combustion chamber. As a result, the valve train is simplified resulting in reduced primary and maintenance costs along with more efficient engine operation.

Specific details of several embodiments of the technology are described below with reference to FIGS. 1-8. Other details describing well-known engine components and systems, such as fuel systems, ignition components, fuel pumps, regulators, forced induction systems, and the like, have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-8.

Figure 1:
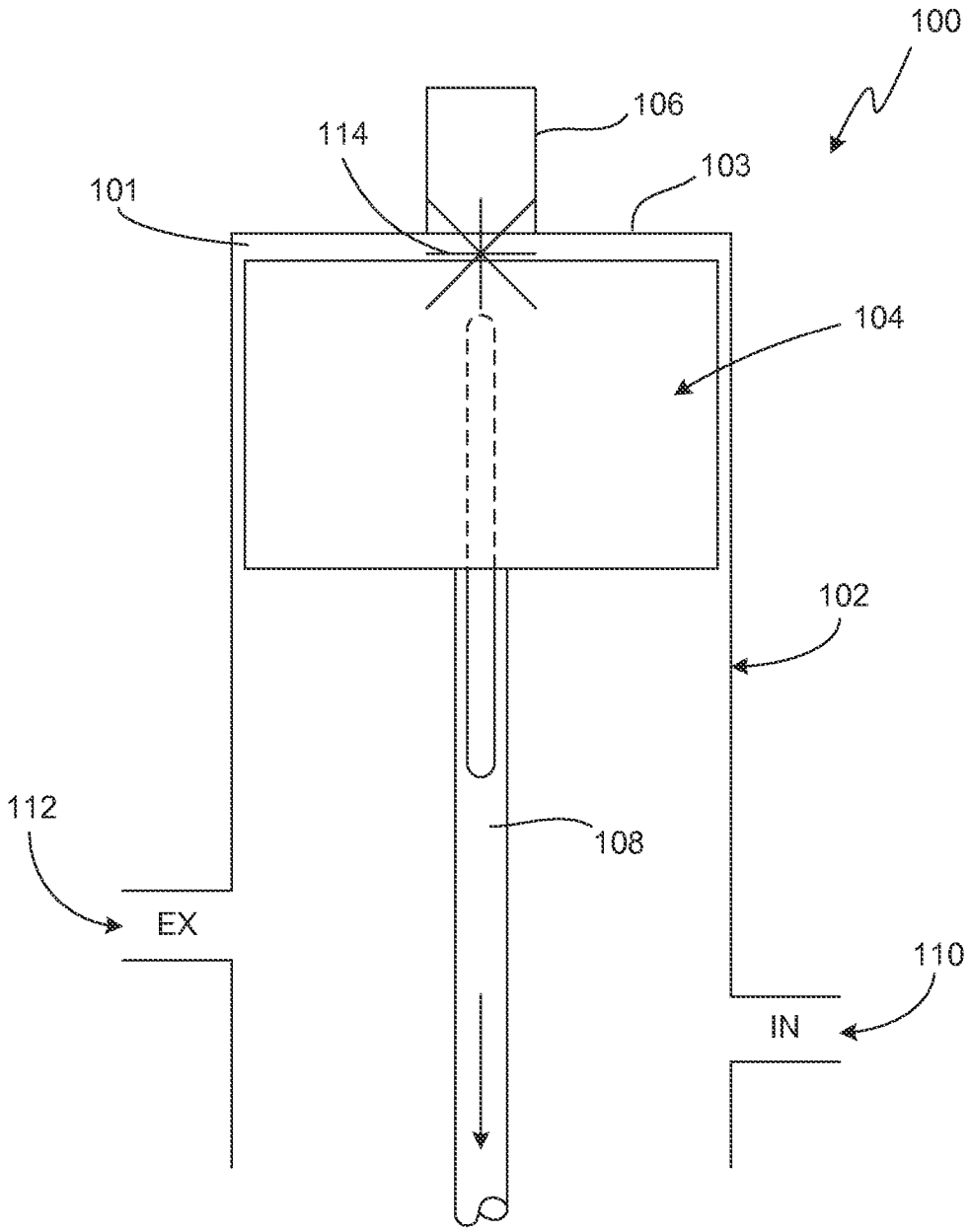
FIG. 1 is a schematic representation of an internal combustion engine according to a representative embodiment.

FIGS. 1-4 schematically illustrate various phases of two-stroke operation of engine 100 according to representative embodiments. With reference to FIG. 1, engine 100 includes a cylinder 102 and a piston 104 slideably disposed therein such that the piston 104 is configured for reciprocating motion within the cylinder 102. The piston 104, head 103 containing chamber 101 and cylinder 102 define a combustion chamber 101 therebetween. The piston 104 is connected to a piston rod 108 that transfers the reciprocating motion of the piston 104 to a suitable motion conversion mechanism, described below, which converts reciprocating motion to rotary motion.

Cylinder 102 includes an intake port 110 that conveys air into the combustion chamber 101 and an exhaust port 112 that conveys exhaust away from the combustion chamber 101. An injector 106 provides fuel by direct injection to the combustion chamber, which is then ignited by compression or other methods such as spark, projected plasma, corona, laser, microwave, catalytic or hot spot ignition to provide initiation and/or acceleration of combustion 114. Injector 106 may be any suitable injector capable of direct injection of fuel. Furthermore, injector 106 may be an injector-igniter, which includes fuel injection functions as well as spark or plasma ignition functions. An example of a suitable injector-igniter is disclosed in co-pending U.S. patent application Ser. No. 13/841,548, filed Mar. 15, 2013, the disclosure of which is incorporated herein by reference in its entirety.

Figure 2:
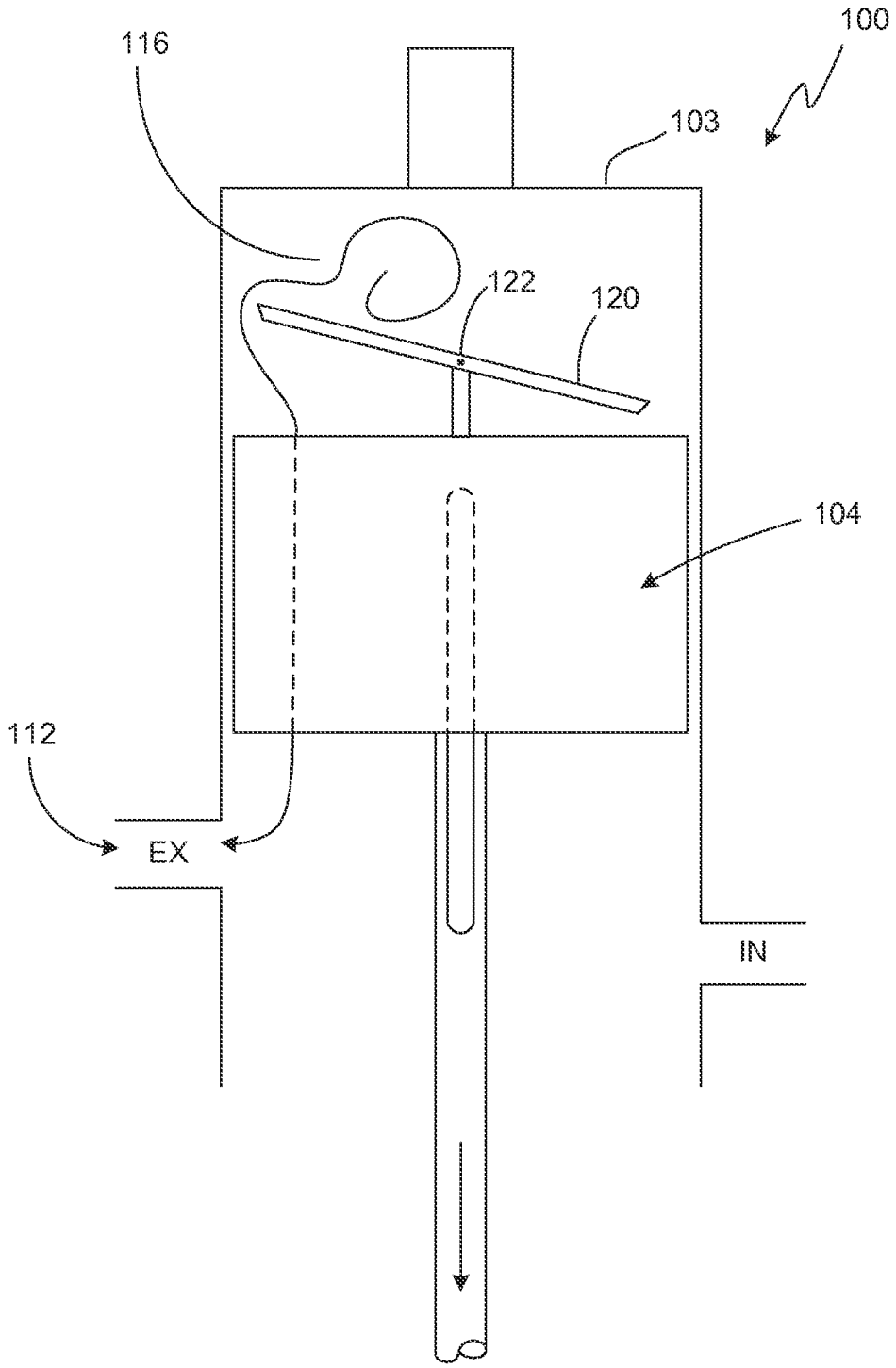
FIG. 2 is a schematic representation of the engine shown in FIG. 1 illustrating an exhaust phase of engine operation.
Figure 3:
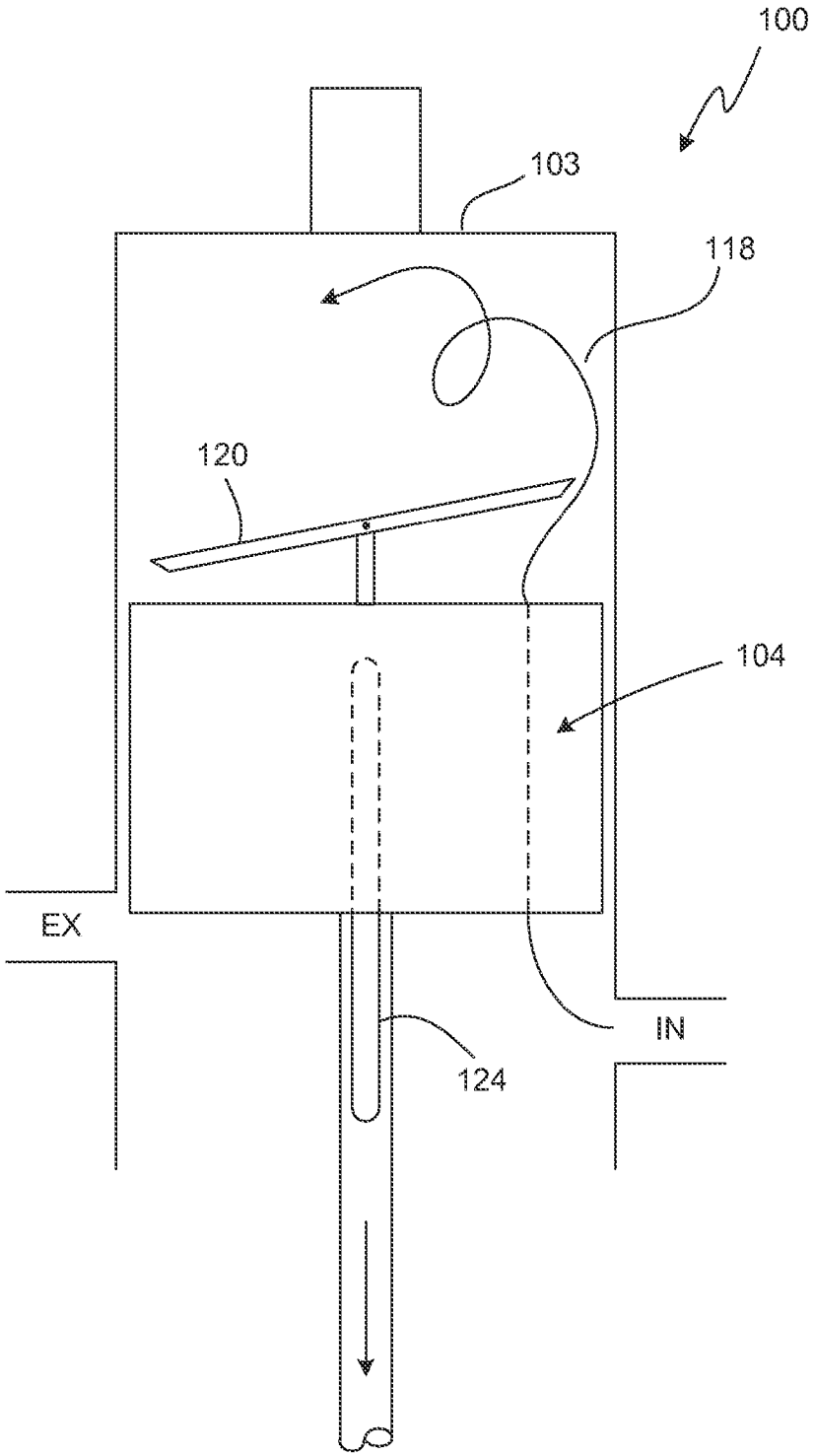
FIG. 3 is a schematic representation of the engine shown in FIGS. 1 and 2 illustrating an intake phase of engine operation.
Figure 4:
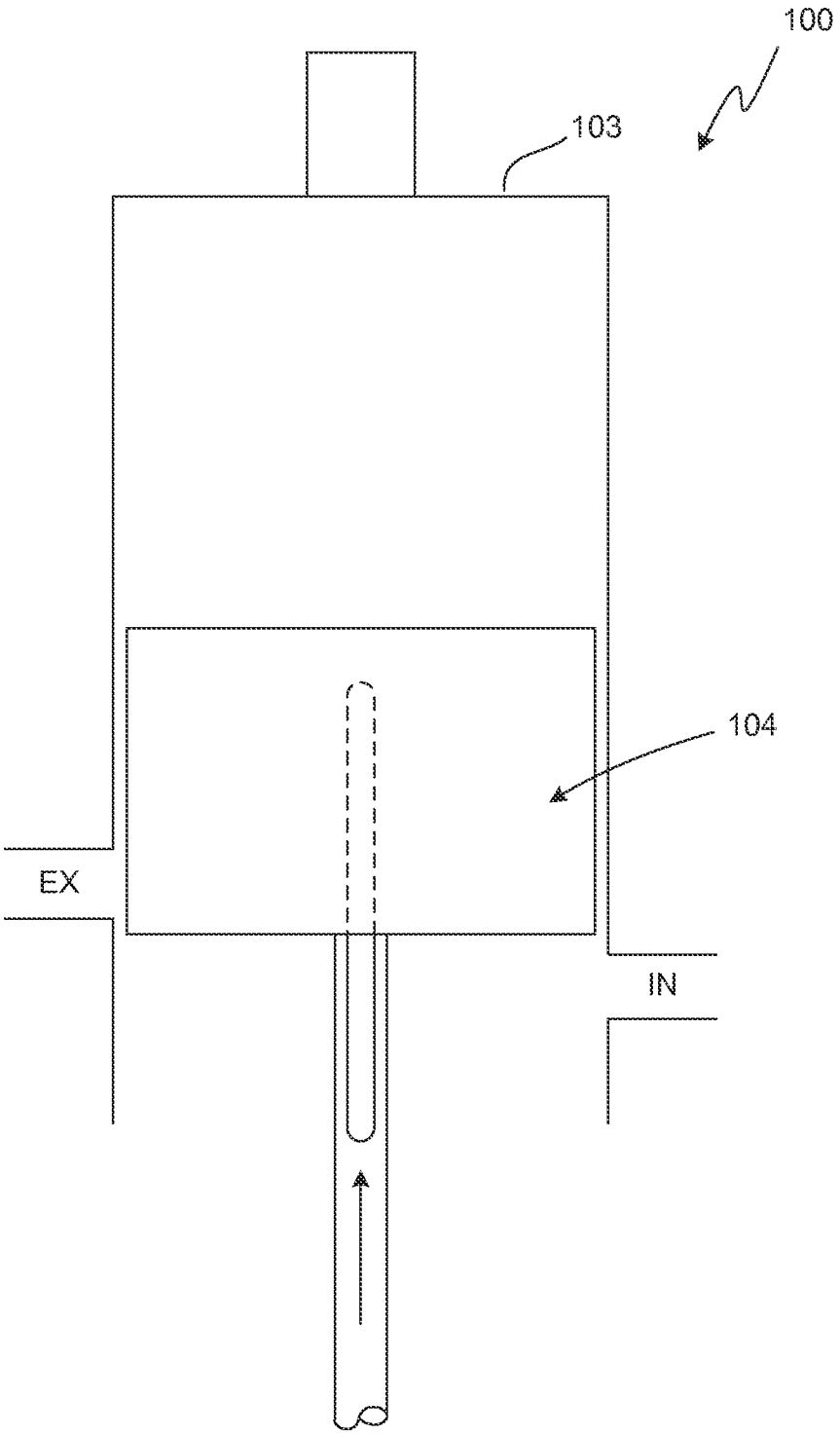
FIG. 4 is a schematic representation of the engine shown in FIGS. 1-3 illustrating a compression phase of engine operation.

Once combustion 114 is initiated at a suitable combustion chamber condition, and the piston 104 begins to move away from top-dead-center (TDC) a power stroke occurs as shown in FIGS. 2 and 2. After the piston 104 moves a certain distance away from TDC, piston valve 120 begins to open such that exhaust gases 116 can flow through one or more passageways in piston 104 out of exhaust port 112. Piston valve 120 is pivotably attached to valve stem 122 such that piston valve 120 can be rocked, tilted, or pivoted, to facilitate intake or exhaust flow. During the first portion of the power stroke the piston valve 120 is tilted clockwise in order to facilitate exhaust flow 116 through piston 104 and out exhaust port 112. As the piston 104 continues further towards bottom-dead-center (BDC), piston valve 120 tilts counter-clockwise as shown in FIG. 3 to facilitate intake air flow 118. In some embodiments the valve tilting and operational timing of events provide flow dynamics that sweeps surplus air and the exhaust gases out of the combustion chamber. The large flow areas provided by the piston valve and the piston motion to compress inlet air into the combustion chamber assures very high volumetric efficiency. The piston 104 includes one or more flow passage(s) that allows the intake and exhaust to flow through the piston when the piston valve 120 is tilted open. To further influence the direction of intake and exhaust flow through the piston 104, piston rod 108 may include a divider 124 of suitable form and shape extending along piston rod 108 as shown. As shown in FIG. 4, once piston 104 travels to about BDC and begins traveling once again towards TDC, the piston valve 120 closes in order to facilitate compression of the intake air charge.

In some embodiments, a forced induction device such as a turbocharger (not shown) is connected to the inlet port 110 in order to provide positive air induction to help control the direction of flow into and out of the combustion chamber 101. As shown in the figures, the exhaust port 112 and intake port 110 are offset from each other with the exhaust port 112 offset towards the piston 104. Accordingly, as piston 104 moves towards BDC the exhaust port 112 is covered while inlet port 110 remains open, thereby further directing the flow of air into the combustion chamber 101.

In another embodiment, the engine 100 can be operated in a 4-stroke mode. For example, the intake stroke occurs as the piston 104 moves toward BDC with the piston valve 120 tilted counter-clockwise to facilitate intake flow. Once the piston 104 reaches BDC, the compression stroke begins as the piston 104 travels back toward TDC with the piston valve 120 closed. Once the piston 104 reaches TDC, combustion is initiated on the power stroke and the piston 104 travels back toward BDC with the piston valve 120 closed. Subsequently, the piston 104 approaches BDC, piston valve 120 is opened and tilted clockwise to facilitate exhaust flow as the piston 104 travels toward BDC and reverses to travel toward TDC during the exhaust gas clearing stroke and valve 120 is tilted counterclockwise to facilitate the air sweep into the combustion chamber with improved volumetric efficiency.

Figure 5:
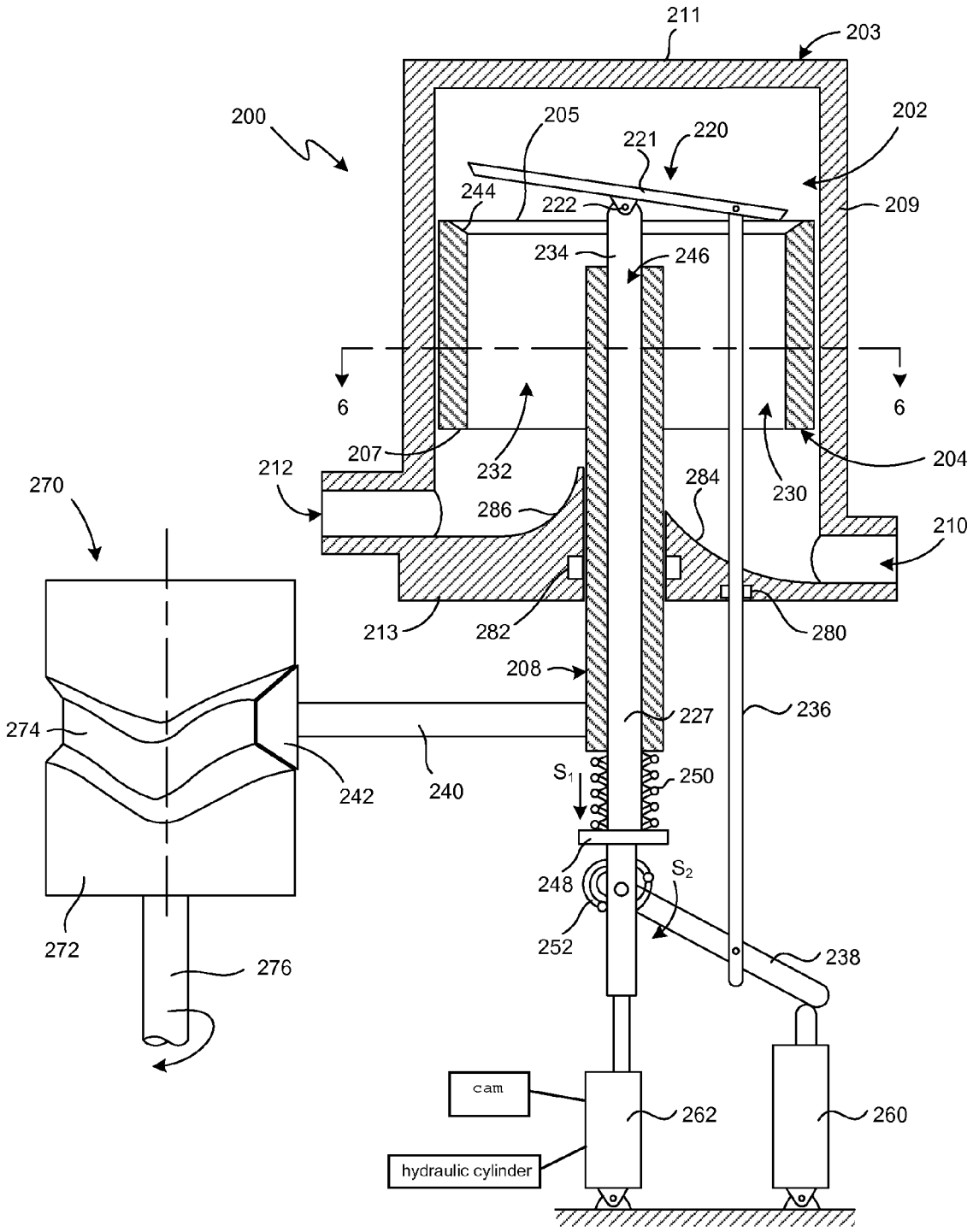
FIG. 5 is a side view in partial cross section of an internal combustion engine according to another representative embodiment.

FIG. 5 illustrates an internal combustion engine according to another representative embodiment. Engine 200 includes a combustion chamber 202 defined by a head portion 211, the surrounding sidewall 203 and a piston 204. The surrounding sidewall 203 includes a cylindrical portion 209, a top portion 211 (e.g., cylinder head), and a bottom portion 213. Cylindrical portion 209 includes an intake port 210 and an exhaust port 212. Bottom portion 213 includes appropriate guide bearings and seals 282 and 280 to seal the piston rod 208 and pivot rod 236. As schematically shown, bearings may include antifriction balls or journals and seals 282 and 280 may be in the form of O-rings. Piston 204 is slideably disposed in the cylindrical portion 209 and includes a top side 205, a bottom side 207, and flow passages 230 and 232 extending through the piston between the top and bottom sides, 205 and 207 respectively.

The piston 204 is connected to a piston rod 208 that transfers the reciprocating motion of the piston 204 to a motion conversion mechanism 270 which converts reciprocating motion to rotary motion. Piston rod 208 is connected to a cam roller 242 via a roller arm 240. Roller 242 rides along a sinusoidal cam path 274 formed around the circumference of a cam drum 272. Output shaft 276 is connected to the cam drum 272. Thus, reciprocating motion of the piston 204 is converted into rotary motion of output shaft 276. Other suitable motion conversion mechanisms are described in U.S. Pat. No. 4,834,033, issued May 30, 1989 and co-pending U.S. patent application Ser. No. 13/396,572, filed Feb. 14, 2012, the disclosures of which are incorporated herein by reference in their entireties.

Figure 6:
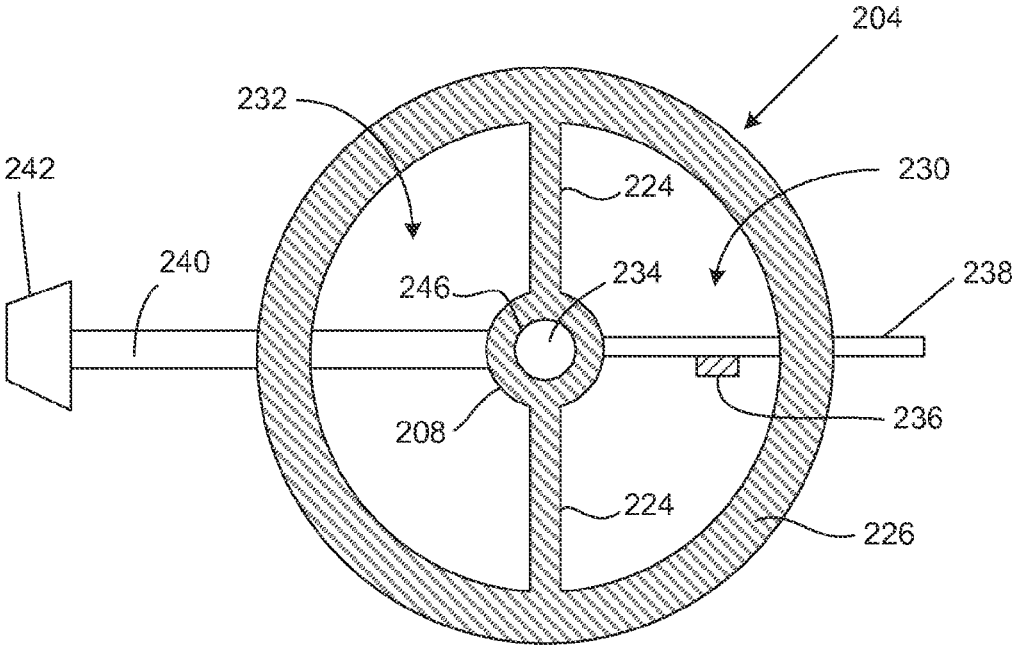
FIG. 6 is a top view in partial cross section of the piston shown in FIG. 5 taken about line 6-6.

The piston 204 includes a piston valve 220, which is operative to seal against a valve seat 244 formed in the top side 205 of the piston 204 when the piston valve 220 is in the closed position. The piston valve 220 includes a valve head 221 attached to valve stem 234 by a pivot 222. Accordingly, valve head 221 may tilt or pivot between a clockwise exhaust position (FIG. 5) and a counter-clockwise intake position (FIG. 7) when the piston valve 220 is in the open position. With further reference to FIG. 6, the valve stem 234 is slideably supported in bore 246 which is formed through piston rod 208. The piston 204 includes a piston skirt 226 that is supported relative to piston rod 208 by dividers 224. Dividers 224 divide the piston skirt 226 into the two separate flow passages 230 and 232. Furthermore, dividers 224 can extend below the skirt 226 along piston rod 208 similar to the dividers 124 shown in FIG. 3. Although the exhaust and intake positions are shown in this embodiment as being clockwise and counter-clockwise, respectively, the intake and exhaust positions may be reversed in other embodiments.

The piston valve 220 is biased to a closed position by a suitable magnet or and/or with compression spring 250 either or both of which may be called the compression spring and which may be in a suitable position such the location proximate to bias annulus or retainer 248 shown in FIG. 5. Compression spring 250 is disposed between the distal end 227 of piston rod 208 and a retainer 248 disposed on valve stem 234. Thus, compression spring 250 provides a biasing force $S_1$ to close piston valve 220. Lift actuator 262 operates against the valve stem 234 in order to open piston valve 220 against the biasing force $S_1$ provided by compression spring 250. Accordingly, the piston valve 220 can be selectively opened to improve various timing events by actuating lift actuator 262. Retainer 248 may be in the form of, for example, a circlip attached to valve stem 234 or a shoulder integrally formed on valve stem 234.

Piston valve head 221 is pivoted between the exhaust and intake positions via linkage, including a pivot rod 236 which is pivotably connected to the valve head 221 and an actuator arm 238. Actuator arm 238 is in turn pivotably connected to the valve stem 234. Torsion spring 252 is disposed on actuator arm 238 and provides a biasing force $S_2$ which biases actuator arm 238 in a clockwise direction corresponding to the exhaust position of the valve head 221. Tilt actuator 260 is operative to act on actuator arm 238 which in turn pushes pivot rod 236 upward in order to rotate the piston valve head 221 counter-clockwise towards the intake position.

With the piston valve head 221 in the exhaust configuration, as shown in FIG. 5, exhaust travels past valve head 221 through valve seat 244 through exhaust flow passage 232 and out exhaust port 212. To facilitate exhaust flow from the combustion chamber, the bottom portion 213 of surrounding sidewall 203 can include contoured region 286. Similarly, to facilitate intake airflow from intake port 210, bottom portion 213 can include a contoured region 284 which helps direct intake flow through intake flow passage 230.

Figure 7:
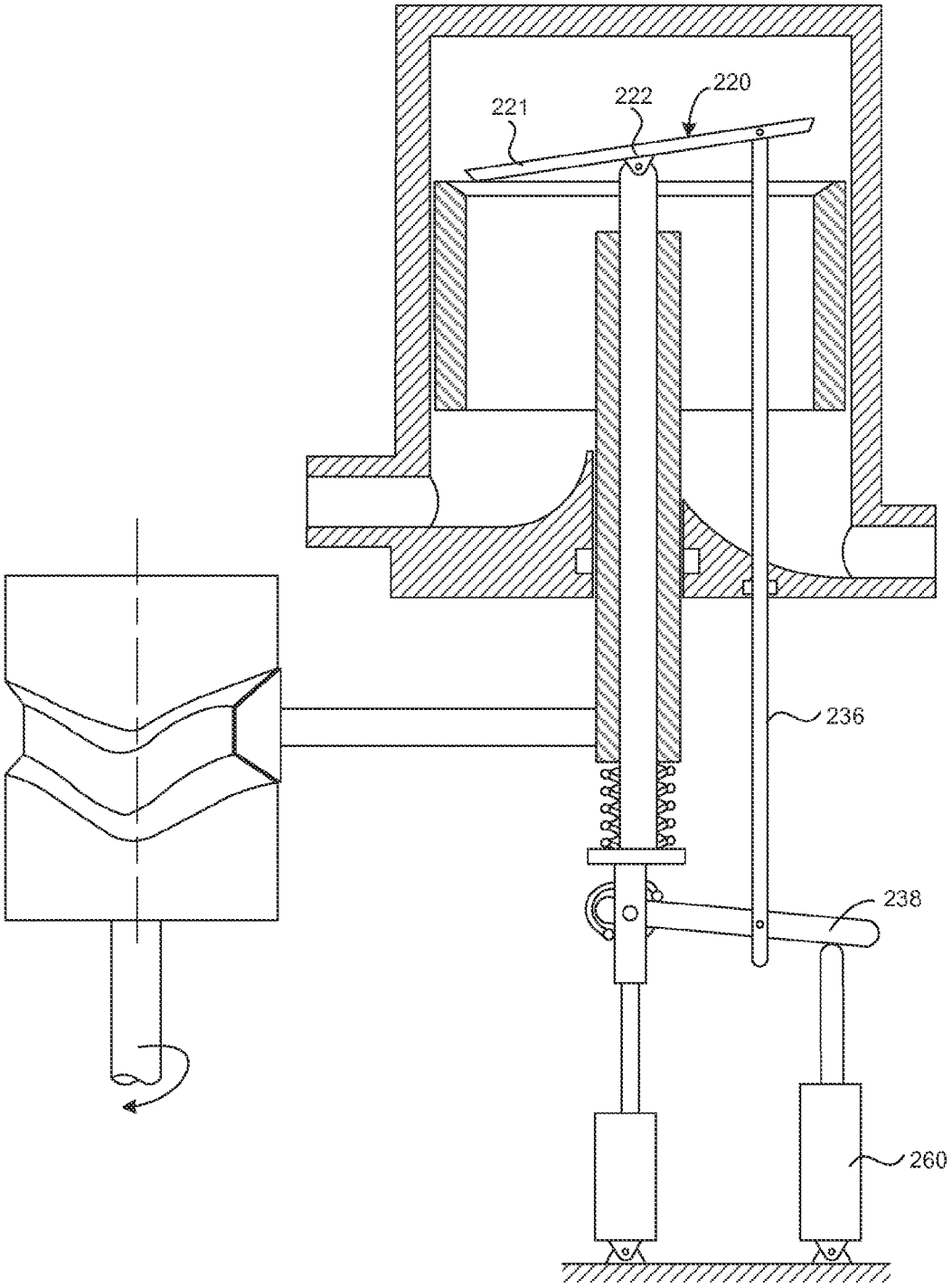
FIG. 7 is a side view in partial cross section of the engine shown in FIGS. 5 and 6 illustrating the piston valve configuration for an intake phase of engine operation.
Figure 8:
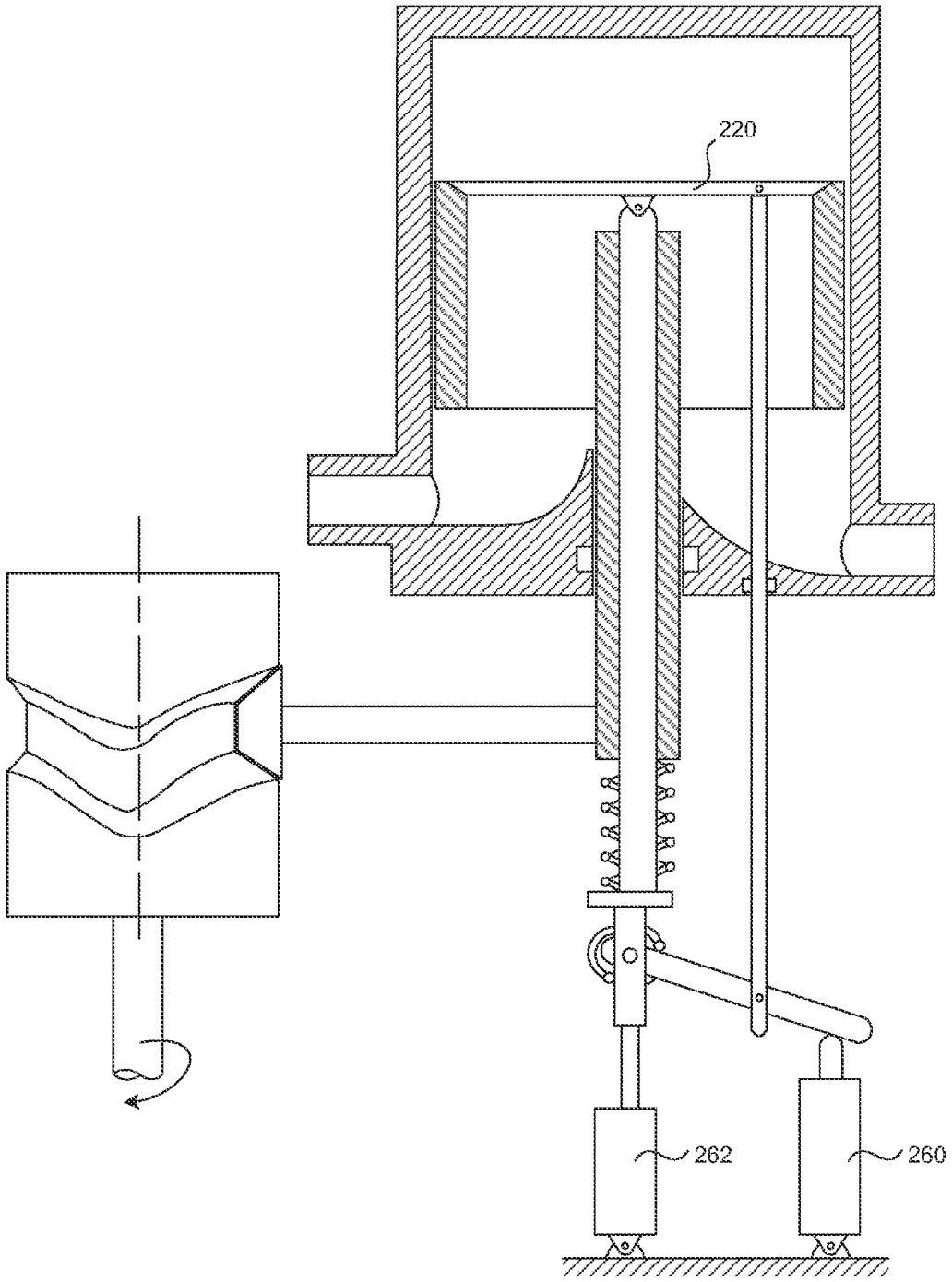
FIG. 8 is a side view in partial cross section of the engine shown in FIGS. 5-7 illustrating the piston valve in a closed configuration.

The valve head 221 can be rotated counter-clockwise to the intake position by actuating tilt actuator 260 which in turn rotates actuator arm 238 counter-clockwise which in turn moves pivot rod 236 upwardly to pivot valve head 221 about pivot 222, as shown in FIG. 7. The piston valve 220 can be dosed, such as during the compression stroke, by retracting lift actuator 262 and tilt actuator 260, as shown FIG. 8. In some embodiments, actuators 262 and 260 may be replaced by one or more suitable cam shafts which are appropriately timed with movement of the piston 204. In other embodiments, piston valve 220 can be operated by pneumatic, hydraulic, electromechanical, magnetostrictive, and/or piezoelectric actuators. Thus, in some embodiments piston valve 220 may be opened at variably adjusted times and to various degrees of opening. Similarly, valve head 221 can be tilted on pivot 222 at variably adjusted times and to various degrees of tilt as appropriate to facilitate intake and exhaust flow. Furthermore, the opening and tilting of piston valve 220 can be electronically controlled with a suitable ECM or control module.

Some aspects of the technology described herein may take the form of or make use of computer-executable instructions, including routines executed by a programmable computer. Those skilled in the relevant art will appreciate that the technology can be practiced on computer systems other than those described herein. The technology can be embodied in a special-purpose computer or data processor, such as an engine control unit (ECU), engine control module (ECM), fuel system controller, or the like, that is specifically programmed, configured or constructed to perform one or more computer-executable instructions consistent with the technology described herein. Accordingly, the term "computer," "processor," or "controller" as generally used herein refers to any data processor and can include ECUs, ECMs, and modules, as well as Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, or dedicated display device or mechanism (e.g., a gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described herein may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

The disclosed technology is described above in the context of particular detailed embodiments. However, the following representative embodiments also fall within the scope of the disclosed technology. In an embodiment, an internal combustion engine comprises a combustion chamber having a surrounding sidewall. A piston is slideably disposed in the surrounding sidewall and includes a top side, a bottom side, and a flow passage extending therebetween. A motion conversion mechanism is operative to convert reciprocating motion of the piston into rotary motion. In some embodiments, the motion conversion mechanism comprises a cam drum and at least one roller connected to the piston rod. A piston rod extends between the piston and motion conversion mechanism. A piston valve is moveable between an open position and a dosed position to control fluid movement through the flow passage. The term fluid, as used herein, encompasses gases, liquids, and other states of matter including, for example and without limitation air, fuel, intake gases, and exhaust gases. The piston valve can include a valve head and a valve stem extending through the piston.

The engine can further comprise an intake port and an exhaust port formed through the surrounding sidewall. In some embodiments, the exhaust port is offset from the intake port toward the piston. In still further embodiments, the engine includes a forced induction device, such as a turbocharger or supercharger, in fluid communication with the intake port. In some embodiments, the valve head is positioned adjacent the top side of the piston and the valve stem extends through the piston rod. In some embodiments, the piston valve can be biased toward the closed position, such as with a retainer disposed on the valve stem and a compression spring disposed between a distal end of the piston rod and the retainer. The engine can further comprise a lift actuator, such as a cam or hydraulic cylinder, connected to the valve stem and operable to move the piston valve between the open and dosed positions.

In some embodiments, the valve head can be pivotably connected to the valve stem and include a linkage connected to the valve head and operative to pivot the valve head between an intake position and an exhaust position. Other embodiments can comprise a tilt actuator connected to the linkage and operable to move the valve head between the intake and exhaust positions. The linkage can comprise a pivot rod connected to the valve head and a lever arm pivotably connected to the valve stem and the pivot rod.

In another embodiment, a flow divider extends along a length of the piston rod and is positioned to direct a fluid flow from the intake port, through the flow passage, and out through the exhaust port. In some embodiments, the intake port and exhaust port are positioned on opposite sides of the flow divider. In other embodiments, the intake port and exhaust port are positioned below the top side of the piston.

Also disclosed herein are methods for operating a two-cycle internal combustion engine having a piston disposed in a surrounding sidewall defining a combustion chamber therebetween. In an embodiment, the method comprises injecting a quantity of fuel into the combustion chamber while the piston is near top dead center; igniting the fuel in the combustion chamber; opening a piston valve including a valve head to expose a flow passage through the piston; pivoting the valve head a first direction to direct an exhaust flow from the combustion chamber through the flow passage and out an exhaust port; pressurizing air through an intake port; covering the exhaust port with the piston; pivoting the valve head a second direction to direct an intake flow from the intake port through the flow passage and into the combustion chamber; and closing the piston valve near bottom dead center.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. The following examples provide additional embodiments of the present technology.

What is claimed is:

1. An internal combustion engine, comprising:

a combustion chamber having a surrounding sidewall;

a piston slideably disposed in the surrounding sidewall and including a top side, a bottom side opposite the top side, and a flow passage extending therebetween, wherein the flow passage includes an intake flow passage and an exhaust flow passage;

a motion conversion mechanism operative to convert reciprocating motion of the piston into rotary motion;

a piston rod extending between the piston and the motion conversion mechanism; and a piston valve moveable between an open position and a closed position to control fluid movement through the flow passage, wherein the piston valve includes:

a valve stem extending through the piston rod, and a valve head pivotably connected to the valve stem and movable between an intake position, wherein a fluid flow is directed through the intake flow passage and into the combustion chamber, and an exhaust position, wherein the fluid flow is directed out of the combustion chamber through the exhaust flow passage.

2. The engine of claim 1, further comprising an intake port and an exhaust port formed through the surrounding sidewall.

3. The engine of claim 2, wherein the exhaust port is offset from the intake port toward the piston.

4. The engine of claim 2, further comprising a forced induction device in fluid communication with the intake port.

5. The engine of claim 4, wherein the forced induction device is a turbocharger.

6. The engine of claim 1, wherein the valve head is positioned adjacent the top side of the piston and the valve stem extends through the piston rod.

7. The engine of claim 6, further comprising a lift actuator connected to the valve stem and operable to move the piston valve between the open and closed positions.

8. The engine of claim 7, wherein the lift actuator comprises a cam.

9. The engine of claim 7, wherein the lift actuator comprises a hydraulic cylinder.

10. The engine of claim 6, wherein the piston valve is biased toward the closed position.

11. The engine of claim 10, further comprising a retainer disposed on the valve stem and a compression spring disposed between a distal end of the piston rod and the retainer.

12. The engine of claim 1, further comprising a linkage connected to the valve head and operative to pivot the valve head between the intake position and the exhaust position.

13. The engine of claim 1, wherein the motion conversion mechanism comprises a cam drum and at least one roller connected to the piston rod.

14. An internal combustion engine, comprising:

a combustion chamber including a surrounding sidewall, an intake port, and an exhaust port;

a piston slideably disposed in the surrounding sidewall and including a top side, a bottom side, and a flow passage extending therebetween;

a motion conversion mechanism operative to convert reciprocating motion of the piston into rotary motion;

a piston rod extending between the piston and the motion conversion mechanism;

a piston valve moveable between an open position and a closed position to control fluid movement through the flow passage, wherein the piston valve includes:

a valve stem extending through the piston rod, and a valve head pivotably connected to the valve stem and movable between an intake position and an exhaust position; and a flow divider extending along a length of the piston rod and positioned to direct a fluid flow from the intake port, through the flow passage, and into the combustion chamber when the valve head is in the intake position and from the combustion chamber though the flow passage, and out through the exhaust port, when the valve head is in the exhaust position.

15. The engine of claim 14, wherein the intake port and the exhaust port are positioned on opposite sides of the flow divider.

16. The engine of claim 15, wherein the intake port and the exhaust port are positioned below the top side of the piston.

17. The engine of claim 14, further comprising a linkage connected to the valve head and operative to pivot the valve head between the intake position and the exhaust position.

18. The engine of claim 17, further comprising a tilt actuator connected to the linkage and operable to move the valve head between the intake position and the exhaust position.

19. The engine of claim 17, wherein the linkage comprises a pivot rod connected to the valve head and a lever arm pivotably connected to the valve stem and the pivot rod.

20. A method for operating a two-cycle internal combustion engine having a piston disposed in a surrounding sidewall defining a combustion chamber therebetween, the method comprising:

injecting a quantity of fuel into the combustion chamber while the piston is near top dead center;

igniting the fuel in the combustion chamber;

opening a piston valve including a valve head to expose a flow passage through the piston;

pivoting the valve head a first direction to direct an exhaust flow from the combustion chamber through the flow passage and out an exhaust port;

pressurizing air through an intake port;

covering the exhaust port with the piston;

pivoting the valve head a second direction to direct an intake flow from the intake port through the flow passage and into the combustion chamber; and closing the piston valve near bottom dead center.

* * * * *

UNITED STATES PATENT AND TRADEMARK OFFICE

CERTIFICATE OF CORRECTION

PATENT NO. : 9,091,204 B2
APPLICATION NO. : 14/213767
DATED : July 28, 2015
INVENTOR(S) : Roy Edward McAlister It is certified that error appears in the above-identified patent and that said Letters Patent is hereby corrected as shown below:

Title Page, item (56)

On page 3, in column 2, under "Other Publications", line 17, delete "Inejct" and insert -- inject --, therefor.

In the Claims

In column 8, line 13, in claim 14, delete "though" and insert -- through --, therefor.

Signed and Sealed this
Fifth Day of April, 2016

Michelle K. Lee

Michelle K. Lee
*Director of the United States Patent and Trademark Office*